US006877712B2

(12) United States Patent
Wiedemann

(10) Patent No.: US 6,877,712 B2
(45) Date of Patent: Apr. 12, 2005

(54) METHOD OF SEALING PRESSURE WITHIN A BLOWOUT PREVENTER AND A BLOWOUT PREVENTER

(75) Inventor: Jim Wiedemann, Edmonton (CA)

(73) Assignee: Vanoil Equipment Inc., Leduc (CA)

( * ) Notice: Subject to any disclaimer, the term of this patent is extended or adjusted under 35 U.S.C. 154(b) by 95 days.

(21) Appl. No.: 10/357,032

(22) Filed: Jan. 30, 2003

(65) Prior Publication Data

US 2004/0084644 A1 May 6, 2004

(30) Foreign Application Priority Data

Nov. 5, 2002 (CA) ..... 2411129

(51) Int. Cl.[7] ..... E21B 33/06
(52) U.S. Cl. ..... 251/1.3
(58) Field of Search ..... 251/1.1, 1.3

(56) References Cited

U.S. PATENT DOCUMENTS 5,180,137 A * 1/1993 Carlson et al. ..... 251/1.3
5,294,088 A * 3/1994 McWhorter et al. ..... 251/1.3
5,713,581 A * 2/1998 Carlson et al. ..... 277/325

OTHER PUBLICATIONS

"Pressure Control Packages for Coiled Tubing Services," Texas Oil Tools, <http://www.tot.com/products/bops.htm> [retrieved Apr. 15, 2003].

"Ram Blowout Preventers for Every Application," NL Industries, Inc., pp. 6150–6156.

"Varco Drilling Equipment," Varco®, <http://www.varco.com/products/VDE/VDE.htm> [retrieved Apr. 15, 2003].

* cited by examiner

*Primary Examiner*—Edward K. Look
*Assistant Examiner*—John K. Fristoe, Jr.
(74) *Attorney, Agent, or Firm*—Christensen O'Connor Johnson Kindness PLLC

(57) ABSTRACT

A blowout preventer which has ram chambers with an upper sealing surface and a lower sealing surface. Upper sealing elements, lower sealing elements and intermediate sealing elements are mounted to the sealing face of each of the rams. The upper sealing elements engage the upper sealing surface. The lower sealing elements engage the lower sealing surface. The intermediate sealing elements are positioned between the upper sealing elements and the lower sealing elements. When the rams are in the sealing position and pressure is exerted from below the rams, sealing engagement between the intermediate sealing elements, the upper sealing elements and the upper sealing surface contain such pressure from below. When the rams are in the sealing position and pressure is exerted from above the rams, sealing engagement between the intermediate sealing elements, the lower sealing elements and the lower sealing surface contains such pressure from above.

7 Claims, 6 Drawing Sheets

METHOD OF SEALING PRESSURE WITHIN A BLOWOUT PREVENTER AND A BLOWOUT PREVENTER

FIELD OF THE INVENTION

The present invention relates to a method of sealing pressure within a blowout preventer used on wellheads of oil and gas wells, and a blowout preventer fabricated in accordance with the teachings of the method.

BACKGROUND OF THE INVENTION

A housing of a blowout preventer has a vertical bore. Sealing elements are positioned in recesses on opposed sides of the bore. The sealing elements are movable between a retracted position within the recesses and a sealing position in which they close off the bore. Rams are used to move the sealing elements between the retracted position and the sealing position. The rams are housed in ram chambers extending out horizontally from the housing.

When the sealing elements are moved by the rams into the sealing position, the sealing elements contain well pressure originating from below the sealing elements. However, existing blowout preventers can not be pressurized from above, as the pressure would tend to separate the sealing elements. The ability to pressurize from above enables equipment installed above the blowout preventer to be tested before the blowout preventer is opened in order to ensure that the equipment is assembled correctly and will not leak wellbore fluids to atmosphere. This protects the health and safety of rig workers, as well as the environment.

SUMMARY OF THE INVENTION

What is required is a method of sealing pressure within a blowout preventer that is capable of holding pressure from both above and below the sealing elements.

According to one aspect of the present invention there is provided a blowout preventer which includes a housing having a vertical bore and at least one pair of opposed horizontal ram chambers. The ram chambers have an upper sealing surface and a lower sealing surface. Rams are reciprocally movable in the ram chambers between a retracted position spaced from the vertical bore and a sealing position closing off the vertical bore. Each ram has a sealing face and an opposed face. Upper sealing elements, lower sealing elements and intermediate sealing elements are mounted to the sealing face of each of the rams. The upper sealing elements engage the upper sealing surface. The lower sealing elements engage the lower sealing surface. The intermediate sealing elements are positioned between the upper sealing elements and the lower sealing elements.

According to another aspect of the present invention there is provided a method of sealing pressure within a blowout preventer. A blowout preventer is provided with upper sealing elements, lower sealing elements and intermediate sealing element, as described above. When the rams are in the sealing position and pressure is exerted from below the rams, sealing engagement between the intermediate sealing elements, the upper sealing elements and the upper sealing surface contain such pressure from below. When the rams are in the sealing position and pressure is exerted from above the rams, sealing engagement between the intermediate sealing elements, the lower sealing elements and the lower sealing surface contains such pressure from above.

Although beneficial results may be obtained through the use of the blowout preventer, as described above, if well pressure exceeds the holding capacity of the rams, the pressure will tend to separate the sealing elements. It is, therefore, preferred that supplemental sealing pressure be provided in order to ensure that the sealing elements are not separated as well pressure increases. Even more beneficial results may, therefore, be obtained when a first pressure diversion port communicates with the vertical bore below rams and the ram chamber behind the opposed face of the rams, and a second pressure diversion port communicates with the vertical bore above the rams and the ram chamber behind the opposed face of the rams. This enables fluids under pressure to be selectively diverted through a selected one of the first pressure diversion port or the second pressure diversion port to maintain the rams in the sealing position. A choice can be made as to whether to pressurize the rams with fluids from above or below the sealing elements.

It is preferred that a first valve be provided for selectively opening and closing the first pressure diversion port and a second valve for selectively opening and closing the second pressure diversion port. When it is critical that the sealing elements be maintained in the sealing position, the first valve and the second valve can be manipulated to ensure that the greater of the two pressures is diverted to the ram chambers to maintain the sealing elements in the sealing position.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
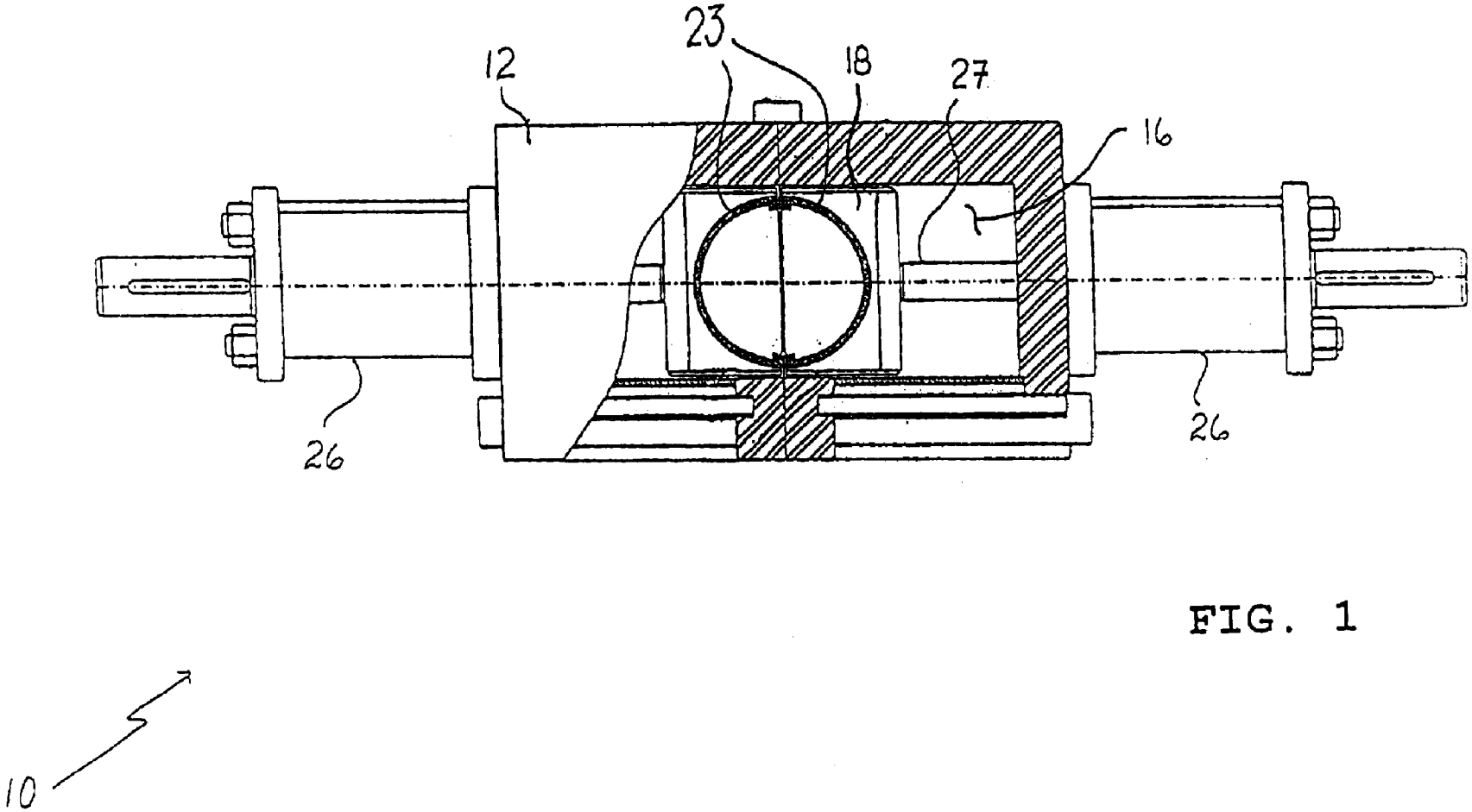
FIG. 1 is a top plan view, in section, of a blowout preventer constructed in accordance with the teachings of the present invention, with sealing elements in the sealing position.
Figure 2:
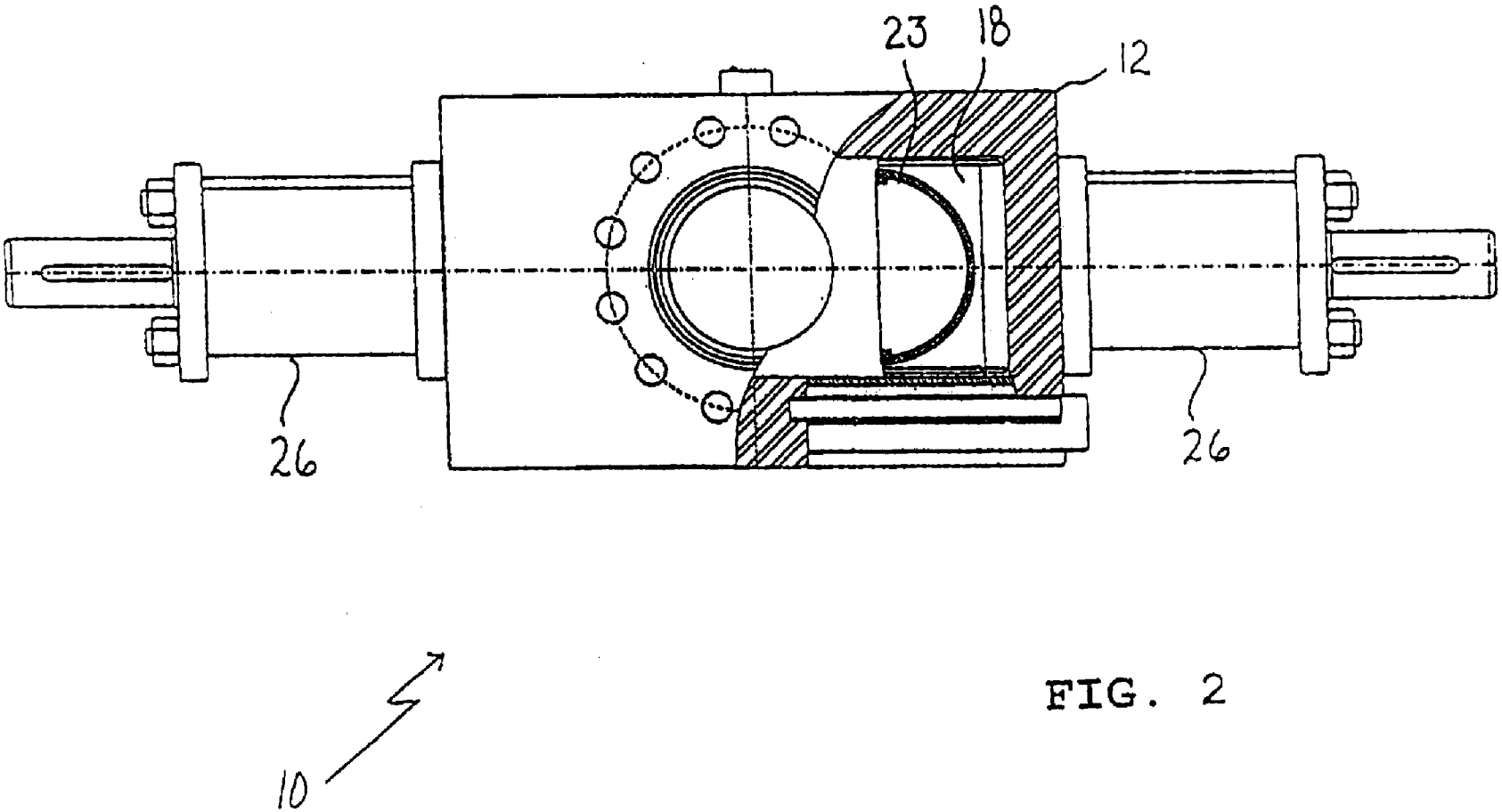
FIG. 2 is a top plan view, in section, of the blowout preventer illustrated in FIG. 1, with sealing elements in the retracted position.

The preferred embodiment, a blowout preventer generally identified by reference numeral 10, will now be described with reference to FIGS. 1 through 6.

Figure 3:
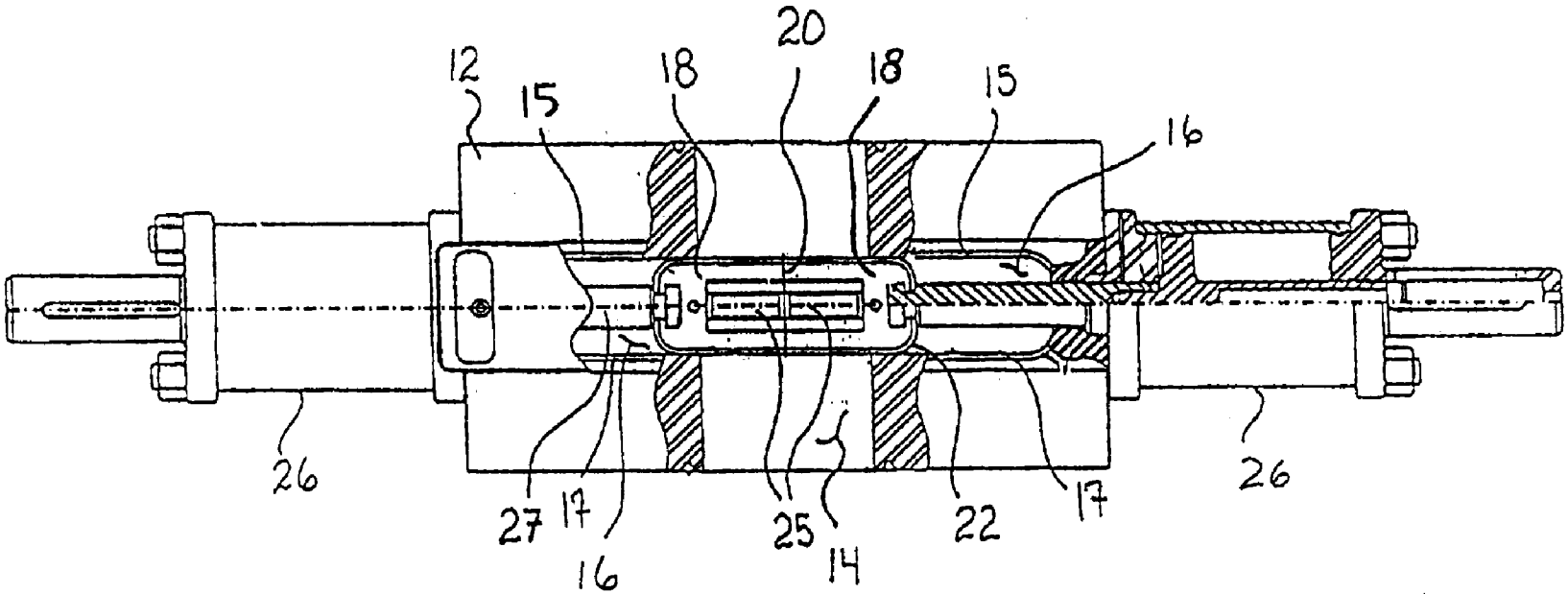
FIG. 3 is a side elevation view, in section, of the blowout preventer illustrated in FIG. 1, with sealing elements in the sealing position.
Figure 4:
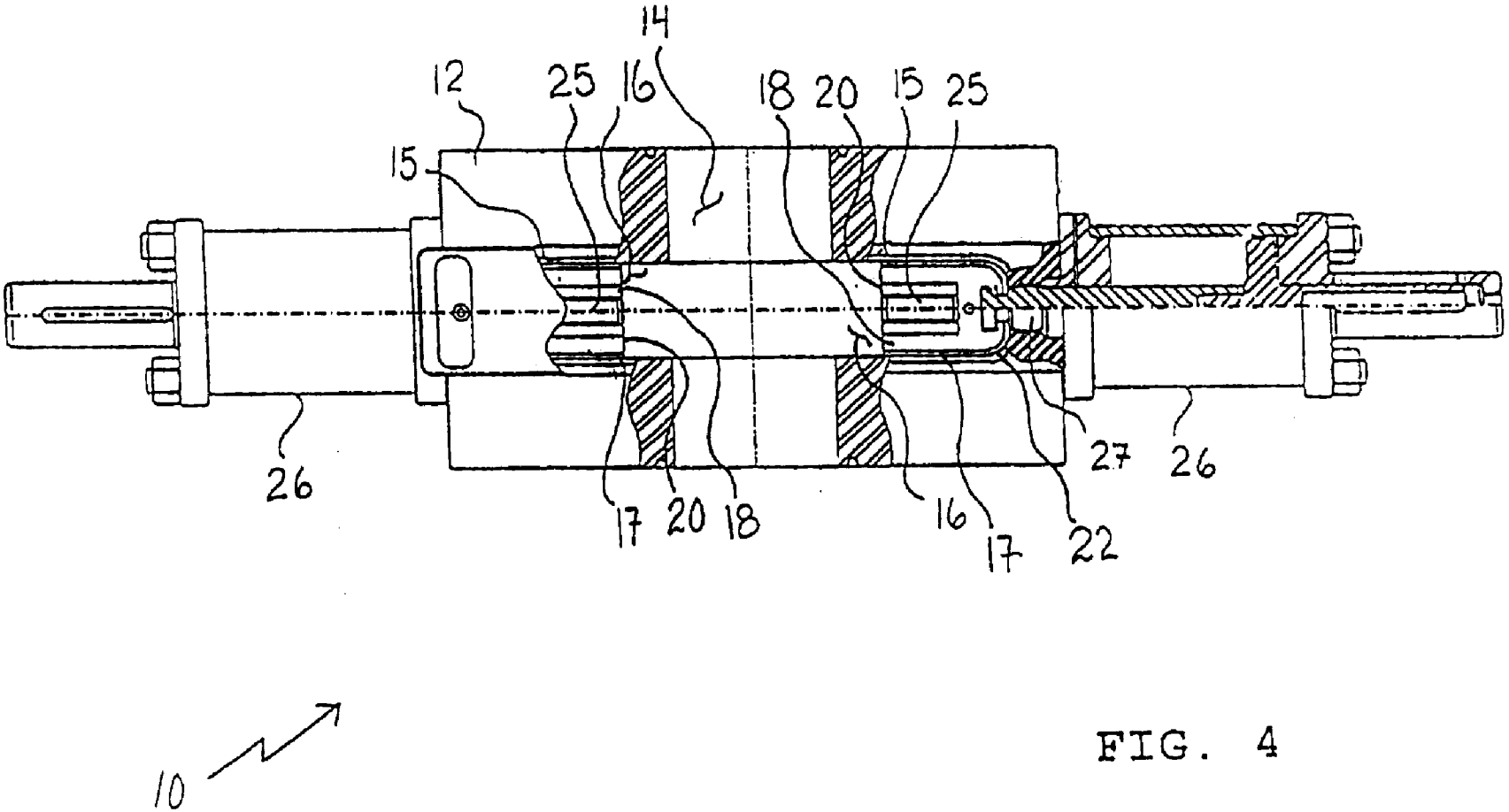
FIG. 4 is a side elevation view, in section, of the blowout preventer illustrated in FIG. 1, with sealing elements in the retracted position.
Figure 6:
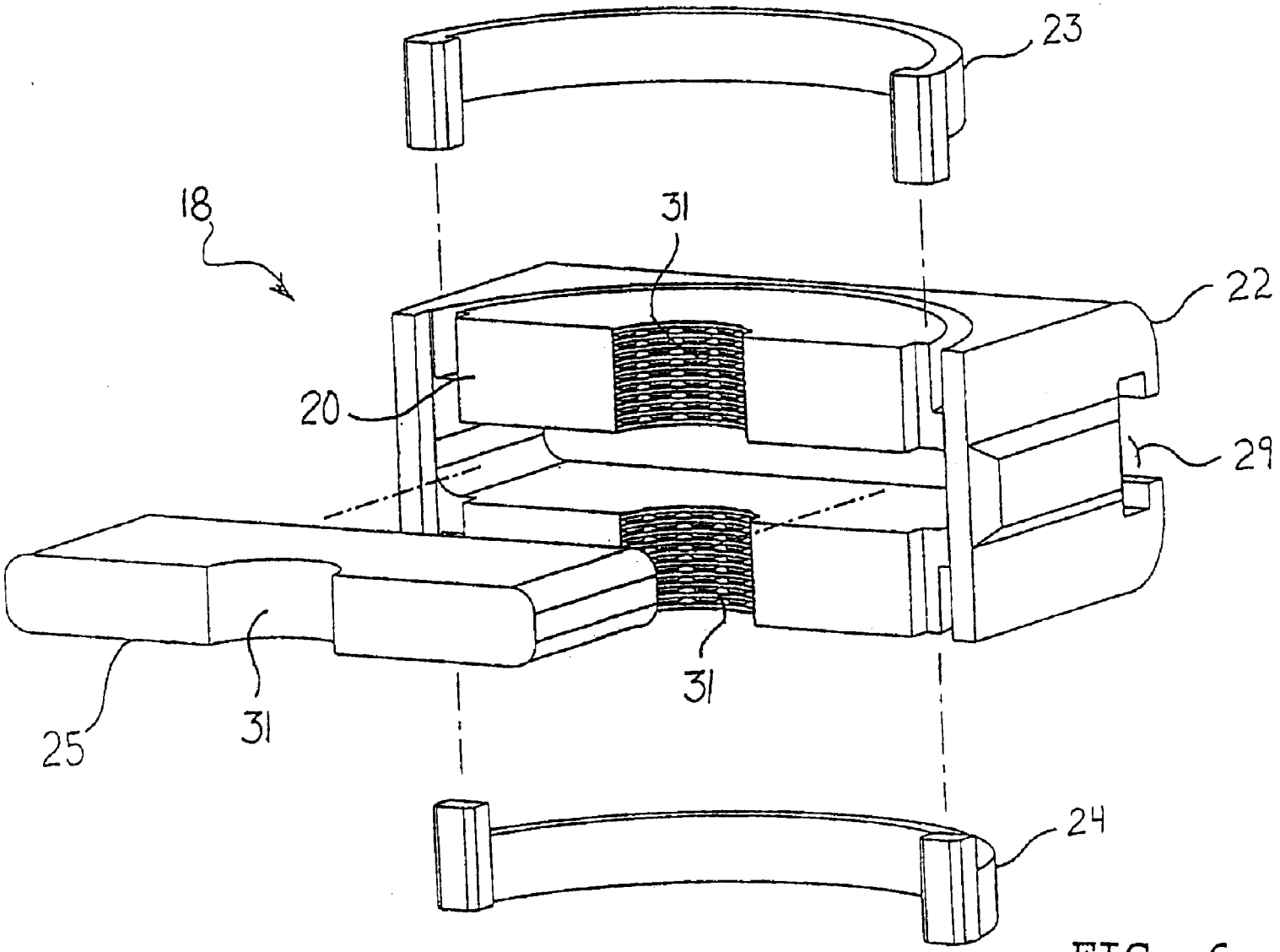
FIG. 6 is an exploded perspective view of the rams of the blowout preventer illustrated in FIG. 1.

Structure and Relationship of Parts:

Referring to FIG. 3, there is provided a blowout preventer 10 which includes a housing 12 that has a vertical bore 14 and a pair of opposed horizontal ram chambers 16. Rams 18 are provided which are reciprocally movable within ram chambers 16 between a retracted position spaced from vertical bore 14 as illustrated in FIG. 4 and a sealing position closing off vertical bore 14 as illustrated in FIG. 3. Each of ram chambers 16 has an upper sealing surface 15 and a lower sealing surface 17. Referring to FIG. 6, each ram 18 has a sealing face 20 and an opposed face 22. An upper sealing element 23, a lower sealing element 24 and an intermediate sealing element 25 are mounted to sealing face 20 of each ram 18. Referring to FIG. 1, hydraulic assemblies 26 are provided on housing 12. Hydraulic assemblies 26 move a piston 27 in and out which pushes and pulls ram 18 between the sealing position and the retracted position. Referring to FIG. 6, opposed face 22 of ram 18 has a coupling channel 29 to facilitate coupling with piston 27. Sealing face 20 of ram 18 and intermediate sealing element 25 can be provided with a "C" shaped profile 31 which is adapted to seal around a pipe, coil tubing or wireline (depending upon the intended application).

Figure 5:
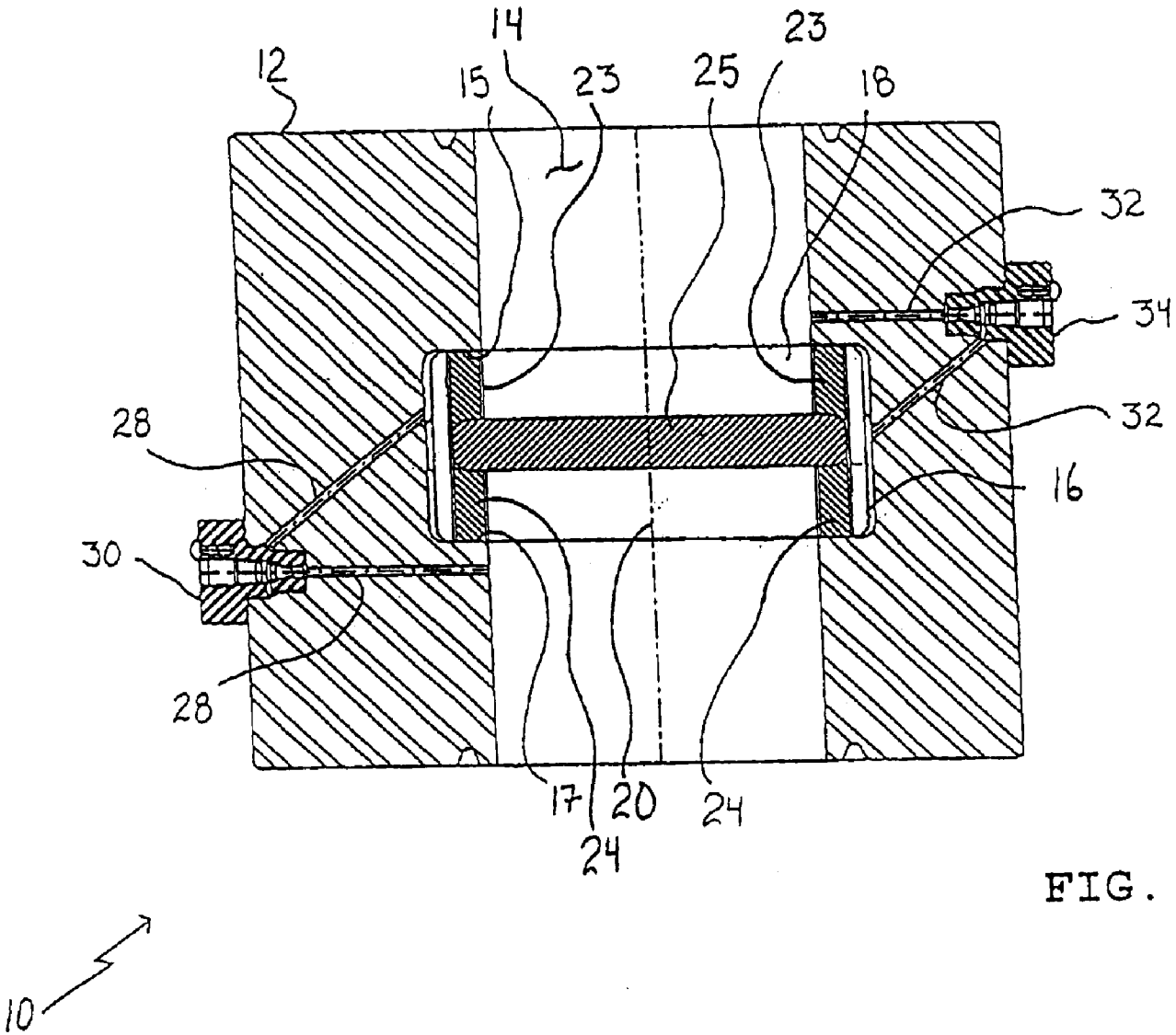
FIG. 5 is a detailed side elevation view, in section, of the pressure diversion ports and valves of the blowout preventer illustrated in FIG. 1.

Referring to FIG. 5, a first pressure diversion port 28 communicates with vertical bore 14 below rams 18 and with ram chamber 16 behind opposed face 22 of rams 18 illustrated in FIG. 3, whereby fluids under pressure from below rams 18 are diverted into ram chamber 16. Referring to FIG. 3, diverted fluids exert a supplementary force upon opposed face 22 of rams 18 to maintain rams 18 in sealing position. Referring to FIG. 5, a first valve 30 is provided for selectively opening and closing first pressure diversion port 28.

A second pressure diversion port 32 communicates with vertical bore 14 above rams 18 and ram chamber 16 behind opposed face 22 of rams 18 illustrated in FIG. 3, whereby fluids under pressure from above rams 18 are diverted into ram chamber 16. Referring to FIG. 3, diverted fluids exert a supplementary force upon opposed face 22 of rams 18, to maintain sealing rams 18 in sealing position. Referring to FIG. 5, a second valve 34 is provided for selectively opening and closing second pressure diversion port 32.

Operation:

The use and operation of blowout preventer generally identified by reference numeral 10, will now be described with reference to FIGS. 1 through 6. Referring to FIG. 5, when sealing faces 20 of rams 18 are engaged in the sealing position and pressure is exerted from below rams 18, sealing engagement between intermediate sealing elements 25, upper sealing elements 23 and upper sealing surface 15 contain such pressure from below. When sealing faces 20 of rams 18 are engaged in the sealing position and pressure is exerted from above rams 18, sealing engagement between intermediate sealing elements 25, lower sealing elements 24 and lower sealing surface 17 contains such pressure from above.

The ability to select contain pressure from either above or below, enables equipment installed above blowout preventer 10 to be tested before blowout preventer 10 is opened in order to ensure that the equipment is assembled correctly and will not leak wellbore fluids to atmosphere. This protects the health and safety of rig workers, as well as the environment.

In addition, first pressure diversion port 28 and second pressure diversion port 32 enable supplemental pressure to be placed upon opposed faces 22 of rams 18 to maintain sealing faces 20 in the sealing position. The configuration allows for a choice as to whether to pressurise rams 18 with fluids from above or below rams 18. When it is critical that sealing faces 20 of rams 18 be maintained in the sealing position, either first valve 30 or second valve 34 can be manipulated to ensure that the greater of the two pressures is diverted to ram chambers 16 to exert additional pressure upon opposed faces 22 of rams 18 to maintain them in the sealing position.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of sealing pressure within a blowout preventer, comprising the steps of:

providing a blowout preventer with ram chambers having an upper sealing surface and a lower sealing surface; and mounting upper sealing elements, lower sealing elements and intermediate sealing elements to a sealing face of rams, the upper sealing elements engaging the upper sealing surface, the lower sealing elements engaging the lower sealing surface, the intermediate sealing elements being position between the upper sealing elements and the lower sealing elements, when the rains are in the sealing position and pressure is exerted from below the rams, sealing engagement between the intermediate sealing elements, the upper sealing elements and the upper sealing surface contain such pressure from below, when the rams are in the sealing position and pressure is exerted from above the rams, sealing engagement between the intermediate sealing elements, the lower sealing elements and the lower sealing surface contains such pressure from above.

2. A method of sealing pressure within a blowout preventer, comprising the steps of:

providing a blowout preventer with ram chambers having an upper sealing surface and a lower sealing surface;

mounting upper sealing elements, lower sealing elements and intermediate sealing elements to a sealing face of rams, the upper sealing elements engaging the upper sealing surface, the lower sealing elements engaging the lower sealing surface, the intermediate sealing elements being position between the upper sealing elements and the lower sealing elements, when the rams are in the sealing position and pressure is exerted from below the rams, sealing engagement between the intermediate sealing elements, the upper sealing elements and the upper sealing surface contain such pressure from below, when the rains are in the sealing position and pressure is exerted from above the rams, sealing engagement between the intermediate sealing elements, the lower sealing elements and the lower sealing surface contains such pressure from above;

including a first pressure diversion port communicating drilling fluids under pressure from above the sealing elements to behind the rams, and a second pressure diversion port communicating with drilling fluids under pressure from below the sealing elements to behind the rams; and selectively diverting drilling fluids under pressure through a selected one of the first pressure diversion port or the second pressure diversion port.

3. A blowout preventer, comprising:

a housing having a vertical bore and at least one pair of opposed horizontal ram chambers, the ram chambers having an upper sealing surface and a lower sealing surface;

rams reciprocally movable in the ram chambers between a retracted position spaced from the vertical bore and a sealing position closing off the vertical bore, each ram having a sealing face and an opposed face; and upper sealing elements, lower sealing elements and intermediate sealing elements mounted to the first end of each of the rams, the upper sealing elements engaging the upper sealing surface, the lower sealing elements engaging the lower sealing surface, the intermediate sealing element being positioned between the upper sealing element and the lower sealing element, such that when the rams are in the sealing position and pressure is exerted from below the rams, sealing engagement between the intermediate sealing elements, the upper sealing elements and the upper sealing surface contain such pressure from below, and when the rams are in the sealing position and pressure is exerted from above the rams, sealing engagement between the intermediate sealing elements, the lower sealing elements and the lower sealing surface contains such pressure from above.

4. A blowout preventer, comprising:

a housing having a vertical bore and at least one pair of opposed horizontal ram chambers, the ram chambers having an upper sealing surface and a lower sealing surface;

rams reciprocally movable in the ram chambers between a retracted position spaced from the vertical bore and a sealing position closing off the vertical bore, each ram having a sealing face and an opposed face;

upper sealing elements, lower sealing elements and intermediate sealing elements mounted to the first end of each of the rams, the upper sealing elements engaging the upper sealing surface, the lower sealing elements engaging the lower sealing surface, the intermediate sealing element being positioned between the upper sealing element and the lower sealing element, such that when the rams are in the sealing position and pressure is exerted from below the rams, sealing engagement between the intermediate sealing elements, the upper sealing elements and the upper sealing surface contain such pressure from below, and when the rams are in the sealing position and pressure is exerted from above the rams, sealing engagement between the intermediate sealing elements, the lower sealing elements and the lower sealing surface contains such pressure from above; and a first pressure diversion port that communicates with the vertical bore below rams and the ram chamber behind the opposed face of the rams, and a second pressure diversion port that communicates with the vertical bore above the rams and the ram chamber behind the opposed face of the rams, whereby fluids under pressure can be selectively diverted through a selected one of the first pressure diversion port or the second pressure diversion port to maintain the rams in the sealing position.

5. The blowout preventer as defined in claim 4, wherein a first valve is provided for selectively opening and closing the first pressure diversion port and a second valve is provided for selectively opening and closing the second pressure diversion port.

6. The blowout preventer as defined in claim 4, wherein the sealing face of the ram and the intermediate sealing element is provided with a "C" shaped profile which is adapted to seal around one of a pipe, coil tubing or wireline.

7. A blowout preventer, comprising:

a housing having a vertical bore and at least one pair of opposed horizontal ram chambers, each of the ram chambers having an upper sealing surface and a lower sealing surface;

rams reciprocally movable in the rain chambers between a retracted position spaced from the vertical bore and a sealing position closing off the vertical bore, each ram having a sealing face and an opposed face;

upper sealing elements, lower sealing elements and intermediate sealing elements mounted to the sealing face of each of the rams, the upper sealing elements engaging the upper sealing surface, the lower sealing elements engaging the lower sealing surface, the intermediate sealing element being positioned between the upper sealing element and the lower sealing element, such that when the rams are in the sealing position and pressure is exerted from below the rams, sealing engagement between the intermediate sealing elements, the upper sealing elements and the upper sealing surface contain such pressure from below, and when the rams are in the sealing position and pressure is exerted from above the rams, sealing engagement between the intermediate sealing elements, the lower sealing elements and the lower sealing surface contains such pressure from above;

a first pressure diversion port communicating with the vertical bore below the rams and the ram chamber behind the opposed face of the rams, and a second pressure diversion port communicating with the vertical bore above the rams and the ram chamber behind the opposed face of the rams, whereby fluids under pressure can be selectively diverted through a selected one of the first pressure diversion port or the second pressure diversion port to maintain the rams in the sealing position; and a first valve for selectively opening and closing the first pressure diversion port and a second valve for selectively opening and closing the second pressure diversion port.

* * * * *

UNITED STATES PATENT AND TRADEMARK OFFICE

CERTIFICATE OF CORRECTION

PATENT NO. : 6,877,712 B2
DATED : April 12, 2005
INVENTOR(S) : J. Wiedemann

It is certified that error appears in the above-identified patent and that said Letters Patent is hereby corrected as shown below:

Column 4,
Lines 25 and 49, “rains” should read -- rams --.

Column 6,
Line 18, “rain” should read -- ram --.

Signed and Sealed this

Twenty-seventh Day of September, 2005

JON W. DUDAS
*Director of the United States Patent and Trademark Office*